US007471257B2

(12) United States Patent
Candal et al.

(10) Patent No.: US 7,471,257 B2
(45) Date of Patent: Dec. 30, 2008

(54) ANTENNA ASSEMBLY AND METHOD OF OPERATION THEREOF

(75) Inventors: Alejandro Candal, Davie, FL (US); Aaron R. Allen, Pembroke Pines, FL (US); Jose M. Gonzalez, Miami, FL (US); Francis M. Staszesky, Fort Lauderdale, FL (US)

(73) Assignee: Motorola, Inc., Schaumburg, IL (US)

( * ) Notice: Subject to any disclaimer, the term of this patent is extended or adjusted under 35 U.S.C. 154(b) by 177 days.

(21) Appl. No.: 11/613,244

(22) Filed: Dec. 20, 2006

(65) Prior Publication Data

US 2008/0122727 A1 May 29, 2008

Related U.S. Application Data

(62) Division of application No. 11/247,527, filed on Oct. 11, 2005, now Pat. No. 7,420,516.

(51) Int. Cl.
*H01Q 3/24* (2006.01)

(52) U.S. Cl. ..... 343/876

(58) Field of Classification Search ..... 343/876, 343/702, 722, 793; 455/575.7
See application file for complete search history.

(56) References Cited

U.S. PATENT DOCUMENTS

| | | | | |
|---|---|---|---|---|
| 5,594,457 | A | 1/1997 | Wingo | |
| 5,650,789 | A | 7/1997 | Elliott et al. | |
| 6,034,639 | A | 3/2000 | Rawlins et al. | |
| 6,095,820 | A | 8/2000 | Luxon et al. | |
| 6,195,065 | B1 | 2/2001 | Hung et al. | |
| 6,211,830 | B1 | 4/2001 | Monma et al. | |
| 6,266,018 | B1 | 7/2001 | Otomo | |
| 6,380,903 | B1 | 4/2002 | Hayes et al. | |
| 6,573,868 | B2 | 6/2003 | Johnson et al. | |
| 6,756,943 | B2 * | 6/2004 | Kim et al. | 343/702 |
| 6,847,830 | B1 * | 1/2005 | Vanderhelm et al. | 455/558 |
| 6,859,179 | B2 * | 2/2005 | Chang | 343/702 |
| 7,006,801 | B2 | 2/2006 | Lang | |
| 7,046,205 | B2 * | 5/2006 | Tamez | 343/702 |
| 7,061,433 | B2 * | 6/2006 | Kim et al. | 343/702 |
| 7,088,305 | B2 | 8/2006 | Flask et al. | |
| 7,187,959 | B2 * | 3/2007 | Ponce De Leon et al. | 455/575.7 |
| 7,259,728 | B1 * | 8/2007 | Ostervall | 343/901 |
| 7,403,165 | B2 * | 7/2008 | Qi et al. | 343/702 |
| 2002/0000941 | A1 | 1/2002 | Johnson | |

(Continued)

OTHER PUBLICATIONS

PCT International Search Report for parent case CE14028JAN, dated Sep. 25, 2007. 9 pages.

*Primary Examiner*—Huedung Mancuso

(57) ABSTRACT

The invention concerns an antenna assembly (102) and a method (600) of operation thereof. In one arrangement, the antenna assembly can include a first antenna element (202) and a second antenna element (204), electrically disconnected from the first antenna element and a switching element (210) to selectively connect the first antenna element and the second antenna element. In another arrangement, the method can include the steps of sliding (604) the switching element to a first position to operate the antenna assembly in a first mode of operation and sliding (606) the switching element to a second position to operate the antenna assembly in a second mode of operation. As an example, in the first mode of operation, the antenna assembly can operate as a one-half wavelength antenna. In the second mode of operation, the antenna assembly can operate as a quarter wavelength antenna.

3 Claims, 6 Drawing Sheets

U.S. PATENT DOCUMENTS

2003/0067412 A1 4/2003 Wallace et al.
2007/0247376 A1* 10/2007 Kim et al. ..... 343/702
2008/0074333 A1* 3/2008 Seo ..... 343/702
2008/0122727 A1* 5/2008 Candal et al. ..... 343/876

* cited by examiner

ANTENNA ASSEMBLY AND METHOD OF OPERATION THEREOF

RELATED APPLICATION

This application is a Divisional of application Ser. No. 11/247,527, filed Oct. 11, 2005. Applicant claims priority thereof.

BACKGROUND OF THE INVENTION

1. Field of the Invention

This invention relates in general to communication devices with antennas, and more particularly, to antennas that can be retracted.

2. Description of the Related Art

In today's marketplace, consumers have access to numerous communication devices such as cellular telephones and personal radios, which use antennas. In order to enable the various operations of such devices, several manufacturers have developed innovative and capable antenna systems. For example, some manufacturers provide communication devices that utilize retractable antennas, while others dispense with external antennas altogether, providing antennas that are fully integrated into the body of the communication device. Still others provide antennas of a fixed length, which may protrude from the communication device.

There are two types of antennas that are generally used in communication devices—one-quarter wavelength antennas and one-half wavelength antennas, depending on desired antenna characteristics. One-half wavelength antennas typically have two elements, each of which is capable of operating in a one-quarter-wavelength configuration. The two one-quarter wavelength elements can be brought into electrical contact with each other, to form a one-half wavelength configuration. The same antenna can also be operated in a one-quarter-wavelength configuration, if the two antenna elements are disconnected electrically.

The problem with the one-half wavelength antennas used in cellular devices is that the efficiency of an antenna in a retracted configuration is significantly lower than that of a dedicated one-quarter-wavelength antenna. As an example, one-half wavelength antennas include two parts—a one-quarter wavelength portion of straight wire and a one-quarter wavelength portion of helical wire. In the retracted configuration, the antenna's main radiator is the helical wire section. In this configuration, the one-quarter-wavelength straight-wire section needs to be electrically disconnected from the one-quarter-wavelength helical wire portion. Antenna designers have attempted to resolve the problem by using electrical grounding techniques and other techniques, such as using matching circuits, to achieve a high degree of disconnection. These techniques fail to completely and properly disconnect the one-quarter-wavelength straight wire portion from the one-quarter-wavelength helical wire portion. Not being able to accomplish a proper electrical disconnection results in a failure to correctly operate the antennas in the one-quarter-wavelength configuration.

SUMMARY OF THE INVENTION

The present invention concerns an antenna assembly. The antenna assembly can include a first antenna element, a second antenna element, a non-conducting section, and a switching element. The first antenna element can be physically connected to the second antenna element by the non-conducting section. The non-conducting section can electrically disconnect the first antenna element from the second antenna element, retaining the physical continuity between both. In one arrangement, the switching element can be slid over the non-conducting section to selectively electrically connect the first antenna element and the second antenna element. The switching element can include a conducting element that can be slid over the non-conducting section. Sliding the switching element to appropriate positions over the non-conducting section can enable a first mode of operation or a second mode of operation. The first mode of operation can be a one-half-wavelength mode and the second mode of operation can be a one-quarter-wavelength mode.

In one arrangement, the first antenna element can be a helical radiator and the second antenna element can be a linear radiator. The switching element can be positioned so that the first antenna element is electrically connected to the second antenna element. In this configuration, the first antenna element and the second antenna element can together form the one-half-wavelength antenna. Conversely, the switching element can be positioned so that the first antenna element is electrically disconnected from the second antenna element. In this configuration, the first antenna element can form the one-quarter-wavelength antenna.

Further, the antenna assembly can also comprise an upper spring contact and a lower spring contact. The upper spring contact can be connected to the first antenna element, while the lower spring contact can be connected to the second antenna element. The upper spring contact and the lower spring contact can be the contact points that come into contact with the switching element, to enable the first mode of operation or the second mode of operation.

The present invention also concerns a communication device. The communication device can include a transceiver for transmitting and receiving wireless signals. In one arrangement, the transceiver can include a first antenna element, a second antenna element, a non-conducting section, and a switching element. The first antenna element can be physically connected to the second antenna element by the non-conducting section. The non-conducting section can electrically disconnect the first antenna element from the second antenna element. The switching element can selectively electrically connect the first antenna element and the second antenna element, in order to enable a first mode of operation or a second mode of operation. The switching element can be a conducting element that can be slid over the non-conducting section to connect the first antenna element and the second antenna element.

In the communication device, the first antenna element can be a helical radiator and the second antenna element can be a linear radiator. The switching element can be positioned so that the first antenna element is electrically connected to the second antenna element. In this configuration, the first antenna element and the second antenna element can together form the one-half-wavelength extended antenna. Conversely, the switching element can be positioned so that the first antenna element is electrically disconnected from the second antenna element. In this configuration, the first antenna element can form the one-quarter-wavelength retracted antenna.

The present invention also concerns a method for operating an antenna assembly. The antenna assembly can include a first antenna element, a second antenna element, a non-conducting section, and a switching element. The second antenna element can be connected to the first antenna element by the non-conducting section. The non-conducting section can electrically disconnect the first antenna element from the second antenna element. The switching element can selectively connect the first antenna element and the second antenna element to enable a first mode of operation or a second mode of operation of the antenna assembly.

The method can include the step of sliding the switching element to a first position with respect to the non-conducting section, to operate the antenna assembly in a first mode of operation. The method can further include the step of sliding the switching element to a second position with respect to the non-conducting section, to operate the antenna assembly in a second mode of operation.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE INVENTION

Figure 1:
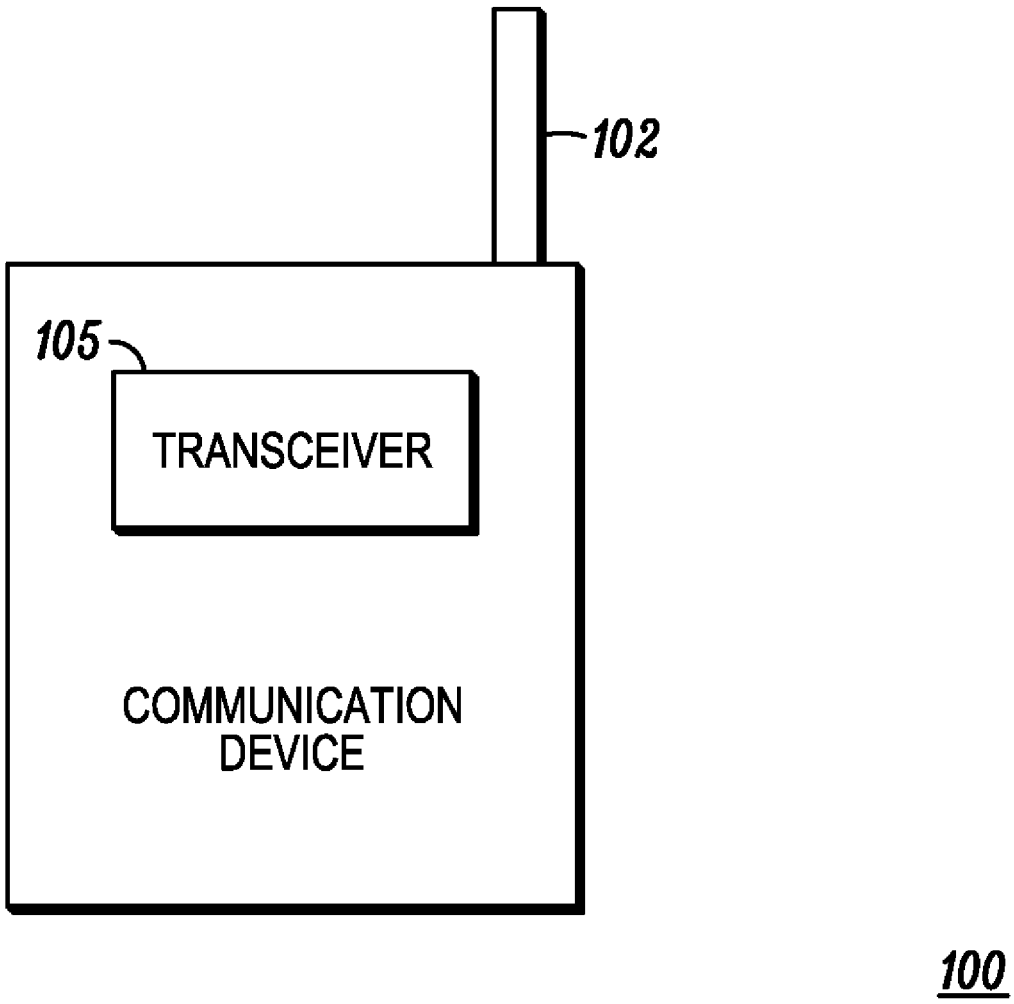
FIG. 1 illustrates an example of a communication device incorporating an antenna assembly, in accordance with an embodiment of the inventive arrangements.

While the specification concludes with claims defining the features of the invention that are regarded as novel, it is believed that the invention will be better understood from a consideration of the following description in conjunction with the drawing figures, in which like reference numerals are carried forward.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "a" or "an," as used herein, are defined as one or more than one. The term "plurality" as used herein, is defined as two or more than two. The term "another" as used herein, is defined as at least a second or more. The terms "including" and/or "having" as used herein, are defined as comprising (i.e., open language). The term "coupled" as used herein, is defined as connected, although not necessarily directly, and not necessarily mechanically.

The invention concerns an antenna assembly and a method of operation thereof. In one arrangement, the antenna assembly can include a first antenna element, a second antenna element, and a non-conducting section. The non-conducting section can be bridged over by a switching element, to selectively electrically connect the first antenna element and the second antenna element. This bridging can enable the antenna assembly to function in a first mode of operation. The non-conducting section, when not bridged over by the switching element, can enable the antenna assembly to function in a second mode of operation. In one arrangement, the first mode of operation can be a one-half-wavelength mode and the second mode of operation can be a one-quarter-wavelength mode. The antenna assembly can therefore operate in the first mode of operation as well as the second mode of operation. It is understood, however, that the invention is in no way limited to operation in these particular examples, as the antenna assembly can be designed to function in other suitable modes.

Referring to FIG. 1, an example of a communication device 100 incorporating an antenna assembly 102, in accordance with an embodiment of the inventive arrangements, is shown. In one embodiment, the antenna assembly 102 can be of a retractable type. Other implementations of the antenna assembly 102 are also possible and do not necessarily require that the antenna is a retractable antenna. As those of skill in the art will appreciate, the communication device 100 can include a transceiver 105 for receiving and/or transmitting any suitable type of wireless signals.

Figure 2:
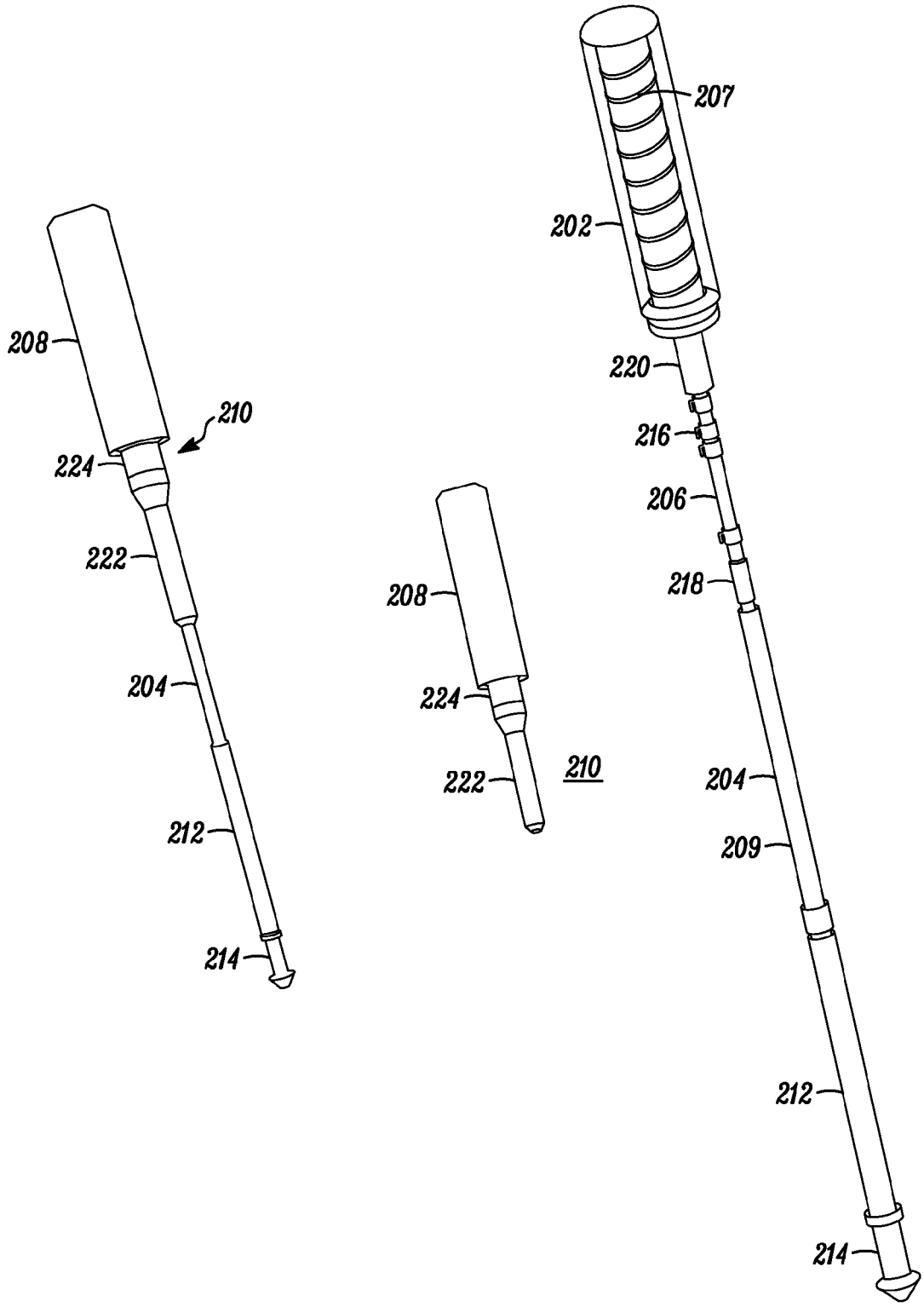
FIG. 2 illustrates an example of representative elements of the antenna assembly, in accordance with an embodiment of the inventive arrangements.

Referring to FIG. 2, examples of representative elements of the antenna assembly 102, in accordance with an embodiment of the inventive arrangements, are shown. Those of skill in the art will appreciate that the antenna elements may include all, or even fewer than, the components shown in FIG. 2. Moreover, those of skill in the art will understand that the antenna elements may include additional components that are not shown here but are not germane to the operation of the antenna elements, in accordance with the inventive arrangements. Several suitable examples of the antenna elements will be presented below.

In one arrangement, the antenna assembly 102 can include a first antenna element 202, a second antenna element 204, a non-conducting section 206, an antenna cap 208, and a switching element 210. The antenna cap 208 can be considered part of the switching element 210. The antenna assembly 102 can have the non-conducting section 206 physically connecting the first antenna element 202 and the second antenna element 204. The first antenna element 202 and the second antenna element 204 can therefore be selectively electrically isolated from each other. The non-conducting section 206 can be made of any suitable non-conductive material.

In one embodiment, the antenna assembly 102 can include an upper spring contact 216 and a lower spring contact 218, both of which can be made of a conductive material and both of which can be coupled to the non-conducting section 206. As an example, the lower spring contact 218 can be coupled to the second antenna element 204, such as through a crimping process. As another example, the upper spring contact 216 can be coupled to the first antenna element 202 through an inner bushing 220. The upper spring contact 216 may also be crimped to the inner bushing 220.

In one arrangement, the first antenna element 202 can be a helical radiator 207 that can be used for the one-quarter-wavelength mode operation. The second antenna element 204 can be a linear radiator 209 that can be used for the one-half wavelength mode of operation when electrically connected to the first antenna element 202. Of course, the first antenna element 202 and the second antenna element 204 can be configured in other suitable forms. As an example, the second antenna element 204 can be a single-piece linear radiator element. The second antenna element 204 can also be composed of more than one piece of radiator element that can, by means of a movable mechanism, together form a single linear radiator element. An example of a movable mechanism can be the telescoping of more than one piece of radiator element, moving through various cumulative linear dimensions at different stages of the telescoping operation.

The antenna assembly 102 can also include a telescoping portion 212, into which the second antenna element 204 can slide out of and into as the antenna assembly 102 is respectively pushed up and down. In another arrangement, the antenna assembly 102 can further have a contact 214 that can be coupled to the second antenna element 204. This contact 214 can enable an electrical engagement with the second antenna element 204 through some suitable component, as will be described below.

As noted above, the switching element 210 can include an antenna cap 208, and the first antenna element 202 can be positioned within the antenna cap 208. The switching element 210 can also include a slide tube 222 and an outside bushing 224, and the slide tube 222 can be coupled to the outside bushing 224. The outside bushing 224 can also be coupled to the antenna cap 208. As a result, when a user grasps the antenna cap 208 and moves it up or down, the outside bushing 224 and the slide tube 222 can correspondingly move, too.

Figure 3:
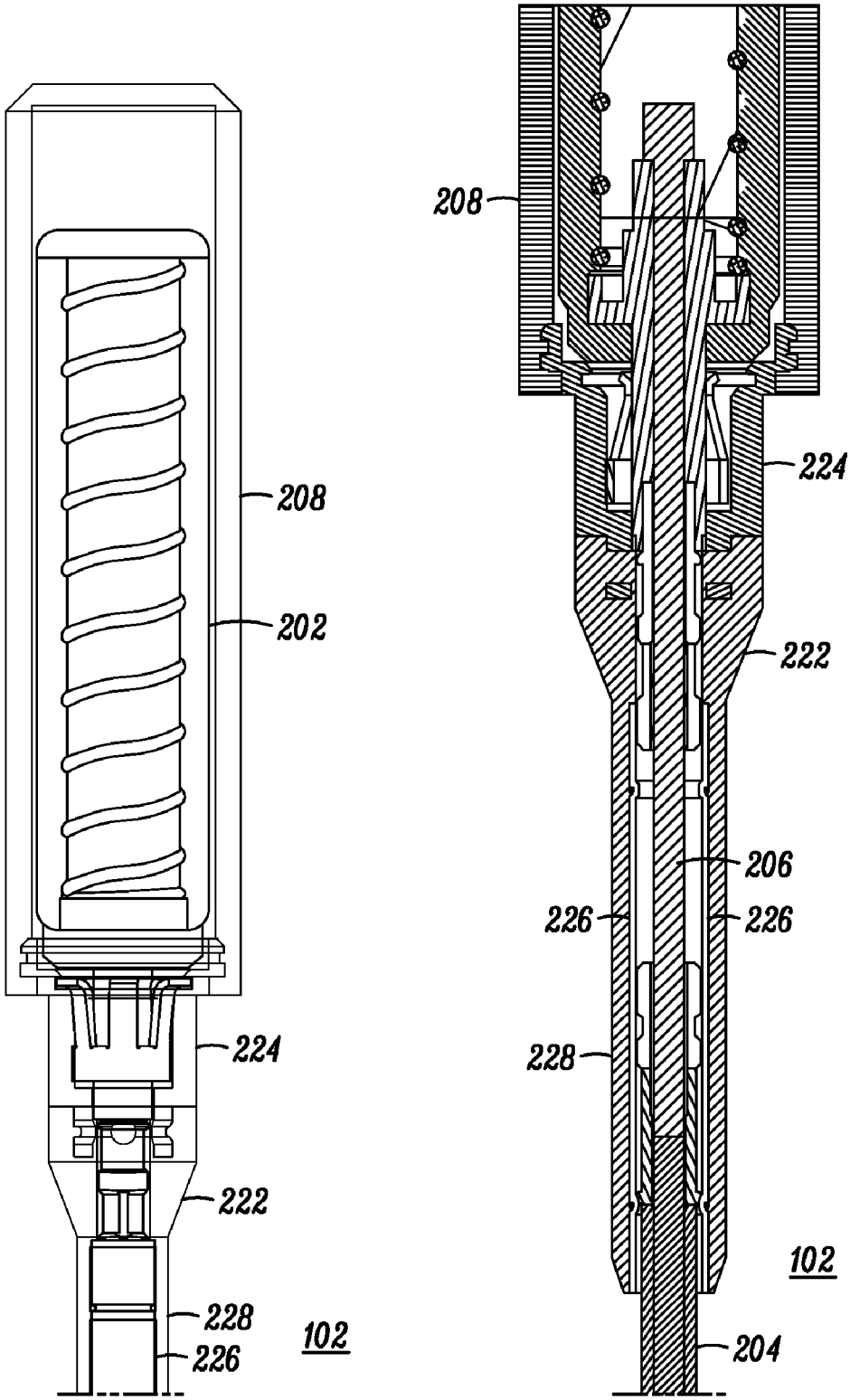
FIG. 3 illustrates an example of the antenna assembly of FIG. 1, operating in a first mode of operation, in accordance with an embodiment of the inventive arrangements.

In one arrangement and as best shown in FIG. 3, the slide tube 222 of the switching element 210 can include a conducting element 226 and a non-conductor element 228. The conducting element 226 can be a tube made of an electrically conducting material or a simple conducting wire or strip. The conducting element 226 can be over-molded with the non-conductor element 228 to form part of the switching element 210 and can be connected to the antenna cap 208 through the outer bushing 224. Those of skill in the art will appreciate that the functions associated with the switching element 210 can be implemented by using any means, to provide a selective electrical connection between the first antenna element 202 and the second antenna element 204. The over-mold coupling can allow the switching element 210 to move with the antenna cap 208, when, say, a user moves the antenna cap 208. The user of the communication device 100 can therefore slide the switching element 210 over the non-conducting section 206, which can configure the antenna assembly 102 to operate in either the first or second mode of operation.

Operating the antenna assembly 102 in more than one mode of operation can be desirable, since the quality of a signal being received by the communication device 100 can be variable over an area of signal reception. The first mode of operation can provide the user with better signal reception and transmission characteristics in areas where the signal strength is less. The user of the communication device 100 can therefore choose to operate the antenna assembly 102 in the first mode of operation by sliding the switching element 210 over the non-conducting section 206. When the communication device 100 is in an area of good signal reception, the user can choose to operate the antenna assembly 102 in the second mode of operation. The user can enable the second mode by retracting the antenna assembly, thus sliding the switching element 210 back over the non-conducting section 206.

The elements pictured in FIG. 3 represent the antenna assembly 102 operating in the first mode of operation, in accordance with an embodiment of the inventive arrangements. Those of skill in the art will appreciate that the antenna assembly 102 may include all, or even fewer than, the components shown in FIG. 3. Further, those of skill in the art will understand that the antenna assembly 102 may include additional components that are not shown here, but are not germane to the operation of the antenna assembly 102, in accordance with the inventive arrangements. Several suitable examples of the antenna elements are provided below.

In one arrangement, the first mode of operation can be the one-half wavelength mode of operation. The user can move the antenna cap 208 to enable the first mode of operation. For example, the user can pull the antenna cap 208 upwards or in some other suitable direction, which can cause the slide tube 222 to move correspondingly. As the slide tube 222 moves, the conducting element 226 can slide upwards or in another suitable direction and can eventually contact both the upper spring contact 216 and the lower spring contact 218. This contact can bridge the electrical gap between the first antenna element 202 and the second antenna element 204. Because the first antenna element 202 and the second antenna element 204 are electrically coupled, the antenna assembly 102 can operate in the first mode of operation, or as a one-half wavelength antenna.

Figure 5:
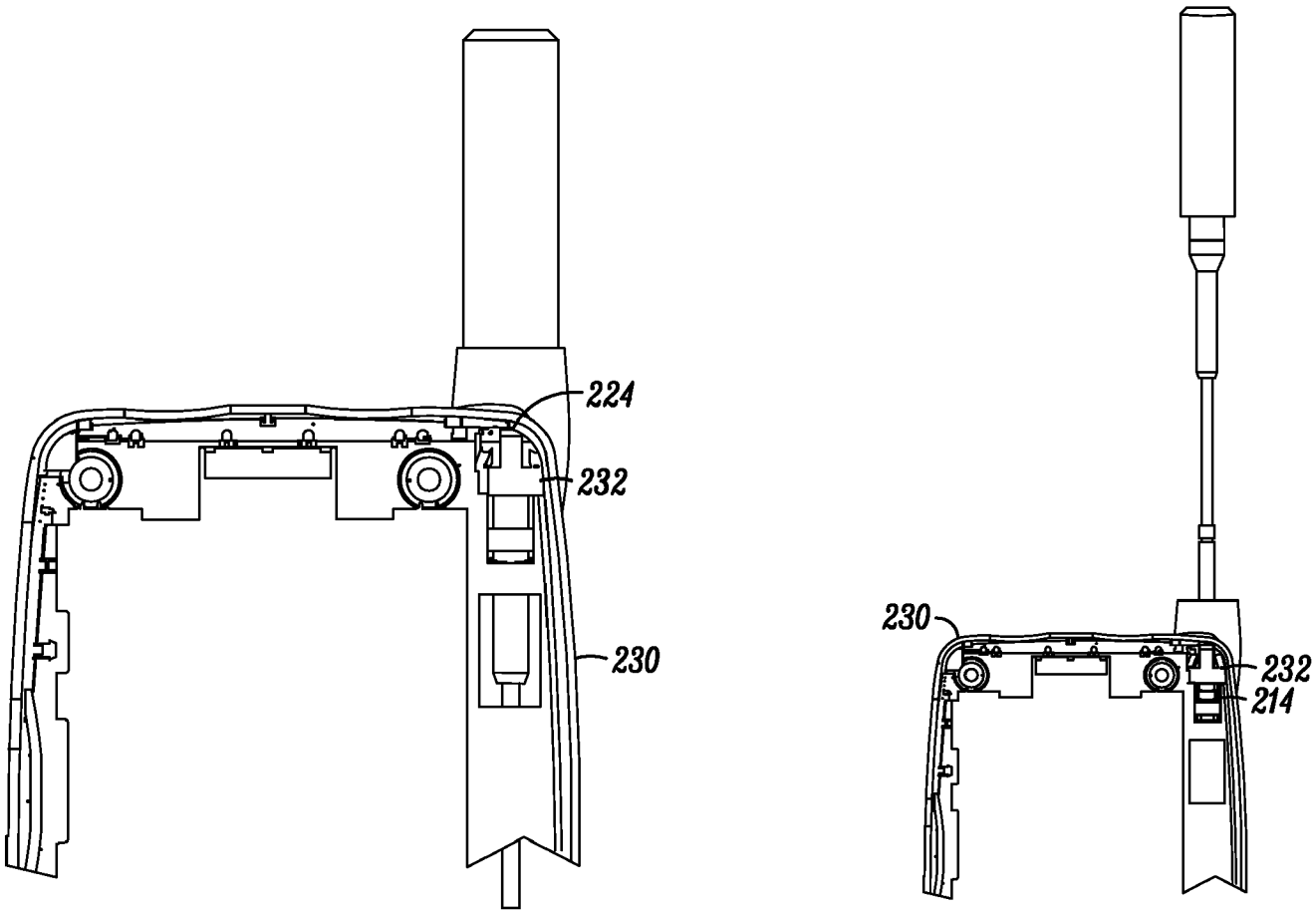
FIG. 5 illustrates an example of the antenna assembly within the housing of a communication device, in accordance with an embodiment of the inventive arrangements.

Referring to FIG. 5, a portion of a housing 230 of the communication device 100 is shown. The antenna assembly 102 is shown here in both the extended (on the right) and retracted (on the left) positions here. The communication device 100 can also include a launch component 232, which can be coupled to a printed circuit board (PCB) (not shown) or some other suitable internal circuitry. The launch component 232 can transfer signals to and from the antenna assembly 102, which can be either relayed to or from the PCB or other circuitry.

In the extended position or the first mode of operation (one-half wavelength), the launch component 232 can engage the contact 214 (see also FIG. 2). Thus, a circuit path can be complete between the PCB and the first antenna element 202 and the second antenna element 204 to allow for operation of the antenna assembly 102 as a one-half wavelength antenna.

Figure 4:
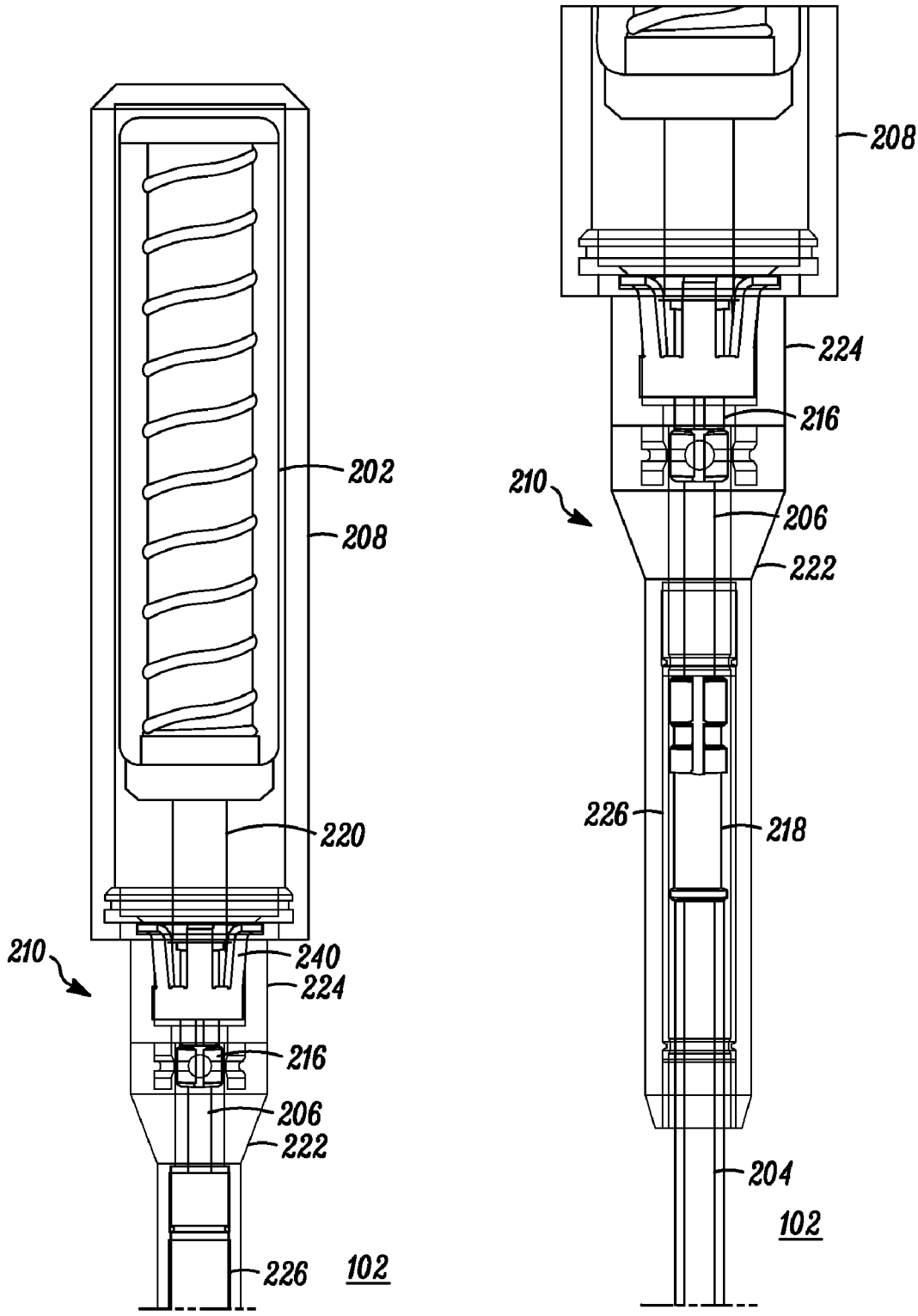
FIG. 4 illustrates an example of the antenna assembly of FIG. 1, operating in a second mode of operation, in accordance with an embodiment of the inventive arrangements.

Referring to FIG. 4, a representative diagram of an example of the antenna assembly 102 in the second mode of operation in accordance with an embodiment of the inventive arrangements is shown. Here, the antenna assembly 102 is in a retracted position. For example, during the operation of the communication device 100, the user can perceive that the communication device 100 is in an area of acceptable signal quality. In this case, the user may force the antenna cap 208 down or in another suitable direction, which can cause the antenna assembly to retract into the communication device 100. This retraction can slide the switching element 210 and can restore the electrical gap between the first antenna element 202 and the second antenna element 204. The retraction can configure the antenna assembly 102 to operate in the second mode of operation, which can be the one-quarter wavelength mode in which the first antenna element 202 is electrically disconnected from the second antenna element 204.

For example, as the antenna cap 208 is forced down, the outer bushing 224 can correspondingly force the slide tube 222 down. As the slide tube 222 moves downward, the conducting element 226 can move in the same direction, causing it to slide away from the upper spring contact 216. As it slides away, the upper spring contact 216 may no longer be in electrical contact with the lower spring contact 218 (in view of the non-conductive element 206).

When the antenna assembly 102 is fully retracted, there can be a gap of a predetermined length between the top of the conducting element 226 and the upper spring contact 216. As an example, this gap can be approximately three millimeters, although other suitable distances may be employed. This gap can create the electrical disconnect between the first antenna element 202 and the second antenna element 204.

Referring to FIG. 5 again, the antenna assembly 102 being in the retracted position is shown on the left. For clarity, please also refer to FIG. 4. In this example, the launch component 232 can engage the outer bushing 224, which can be in contact with another spring contact 240. In addition, the spring contact 240 can engage the inner bushing 220, which can be in contact with the first antenna element 202. As a result, a circuit path can exist between the PCB (or other internal circuitry) of the communication device 100 and the first antenna element 202 with the first antenna element 202 electrically isolated from the second antenna element 204.

Those of skill in the art will appreciate that the antenna assembly 102 can continue to operate in the first mode of operation or the second mode of operation, depending on the particular implementation, during the transition time between the first mode of operation and the second mode of operation. In an exemplary arrangement, the antenna assembly 102 can continue operating in the one-quarter wavelength mode of operation until the switching element 210 bridges the electrical gap between the first antenna element 202 and the second antenna element 204. This can establish electrical continuity between the first antenna element 202 and the second antenna element 204, configuring the antenna assembly to operate in the first mode of operation.

Figure 6:
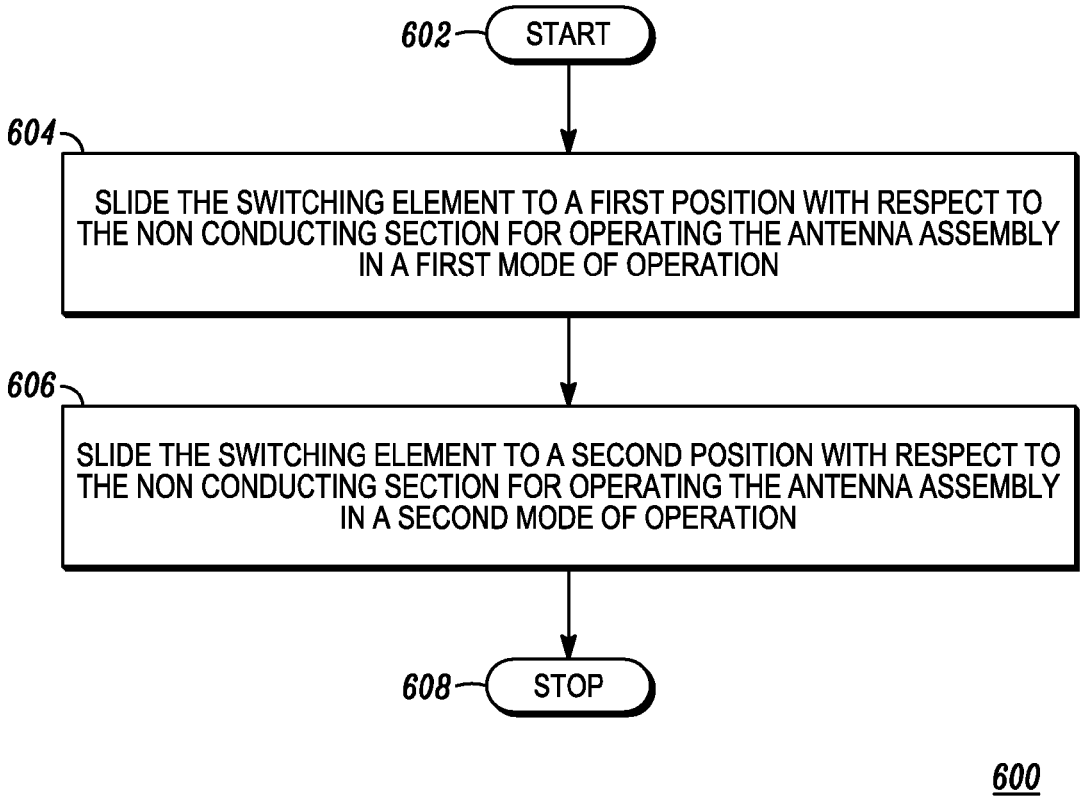
FIG. 6 illustrates an example of a method for operating the antenna assembly in the first mode of operation and the second mode of operation, in accordance with an embodiment of the inventive arrangements.

Referring to FIG. 6, a method 600 for operating the antenna assembly in the first mode of operation and the second mode of operation is shown. To describe the method 600, reference will be made to FIGS. 1-5, although it is understood that the method 600 can be implemented in any other suitable device or system. Moreover, the invention is not limited to the order in which the steps are listed in the method 600. In addition, the method 600 can contain a greater or a fewer number of steps than those shown in FIG. 6. Several suitable examples of the method 600 will be presented below.

In one arrangement, the method 600 can include one or more method steps for operating an antenna assembly in the first mode of operation and the second mode of operation. The method 600 can begin at step 602. At step 604, the switching element 210 can be slid over the non-conducting section 206 to a first position, to operate the antenna assembly 102 in the first mode of operation. In this first position, the upper spring contact 216 and the lower spring contact 218 can be electrically coupled to one another, which can enable the first antenna element 202 and the second antenna element 204 to be electrically coupled together. As an example, the first mode of operation can be the one-half wavelength mode of operation, and this can be configured by extending the antenna assembly.

At step 606, the switching element 210 can be slid over the non-conducting section 206 to a second position, to operate the antenna assembly 102 in the second mode of operation. In the second position, the upper spring contact 216 and the lower spring contact 218 may no longer be in electrical contact with one another. As such, the first antenna element 202 and the second antenna element 204 may be electrically isolated. As an example, the second mode of operation can be the one-quarter wavelength mode of operation, and this can be configured by retracting the antenna assembly. The method 600 can end at step 608.

In one arrangement and in addition to or in lieu of movement initiated by a human, the switching element 210 can be moved to electrically connect or disconnect the first antenna element 202 from the second antenna element 204 by utilizing a motorized antenna system. The motorized antenna system can be configured to switch from the first mode of operation to the second mode of operation, based on the quality of the signal being received by the communication device 100.

In one arrangement, the communication device 100 can notify the user, by means of an audio or vibratory signal, when the quality of the signal being received by the communication device 100 is not acceptable. In this event, the user can extend the antenna to receive better signal quality or the communication device 100 can automatically extend the antenna by using the motorized system.

In one arrangement, the inventive arrangements can apply to a fixed antenna, or one that is not designed to be extendable or retractable. For example, those of skill in the art will appreciate that the communication device 100 can be outfitted with any suitable type of mechanism that would allow the slide tube 222 to move in a suitable direction to selectively electrically couple the first antenna element 202 and the second antenna element 204. That is, the antenna can be fixed, but a slide tube 222 could be positioned to permit it to perform the coupling processes described above. The communication device 100 can be designed to permit a user or some other mechanism to control the movement of the slide tube 222. In this arrangement, the one-half wave and quarter wave applications can apply, although the invention would not be limited as such.

While the preferred embodiments of the invention have been illustrated and described, it will be clear that the invention is not so limited. Numerous modifications, changes, variations, substitutions and equivalents will occur to those skilled in the art, without departing from the spirit and scope of the present invention, as defined by the appended claims.

What is claimed is:

1. A method of operating an antenna assembly, the antenna assembly comprising a first antenna element, a second antenna element and a switching element, the second antenna element being connected to the first antenna element by a non-conducting section, the method comprising:

sliding the switching element to a first position with respect to the non-conducting section for operating the antenna assembly in a first mode of operation; and sliding the switching element to a second position with respect to the non-conducting section for operating the antenna assembly in a second mode of operation.

2. The method according to claim 1, wherein the switching element connects the first antenna element to the second antenna element at the first position.

3. The method according to claim 1, wherein the switching element disconnects the first antenna element from the second antenna element at the second position.

* * * * *